US010588210B1

(12) United States Patent
Vinokhodov et al.

(10) Patent No.: US 10,588,210 B1
(45) **Date of Patent: *Mar. 10, 2020**

(54) HIGH BRIGHTNESS SHORT-WAVELENGTH RADIATION SOURCE (VARIANTS)

(71) Applicants: Isteq B.V., Eindhoven (NL); RnD-ISAN, Ltd, Troitsk, Moscow (RU)

(72) Inventors: Aleksandr Yurievich Vinokhodov, Moscow (RU); Vladimir Vitalievich Ivanov, Moscow (RU); Konstantin Nikolaevich Koshelev, Moscow (RU); Mikhail Sergeyevich Krivokorytov, Moscow (RU); Vladimir Mikhailovich Krivtsun, Moscow (RU); Aleksandr Andreevich Lash, Moscow (RU); Vyacheslav Valerievich Medvedev, Moscow (RU); Yury Viktorovich Sidelnikov, Moscow (RU); Oleg Feliksovich Yakushev, Korolyev (RU); Oleg Borisovich Khristoforov, Moscow (RU); Denis Aleksandrovich Glushkov, Nivegejn (NL); Samir Ellwi, Crawley (GB)

(73) Assignees: Isteq B.V., Eindhoven (NL); RnD-ISAN, Ltd, Troitsk, Moscow (RU)

( * ) Notice: Subject to any disclaimer, the term of this patent is extended or adjusted under 35 U.S.C. 154(b) by 0 days.

This patent is subject to a terminal disclaimer.

(21) Appl. No.: 16/535,404

(22) Filed: Aug. 8, 2019

Related U.S. Application Data

(63) Continuation-in-part of application No. 16/103,243, filed on Aug. 14, 2018, now abandoned.

(30) Foreign Application Priority Data

Apr. 26, 2019 (RU) ..... 2019113052

(51) Int. Cl.
*H05G 2/00* (2006.01)

(52) U.S. Cl.
CPC ..... *H05G 2/005* (2013.01); *H05G 2/006* (2013.01); *H05G 2/008* (2013.01)

(58) Field of Classification Search
CPC ..... H05G 2/005; H05G 2/006; H05G 2/008
(Continued)

(56) References Cited

U.S. PATENT DOCUMENTS

2019/0166679 A1* 5/2019 Vinokhodov ..... H05G 2/005

* cited by examiner

*Primary Examiner* — Nicole M Ippolito
*Assistant Examiner* — Hanway Chang
(74) *Attorney, Agent, or Firm* — Nadya Reingand; Yan Hankin

(57) ABSTRACT

High-brightness short-wavelength radiation source contains a vacuum chamber with a rotating target assembly having an annular groove, an energy beam focused on the target, a useful short-wavelength radiation beam coming out of the interaction zone, wherein the target is a layer of molten metal formed by a centrifugal force on a surface of the annular groove facing a rotation axis. A replaceable membrane made of carbon nanotubes may be installed on a pathway of the short-wavelength radiation beam for debris mitigation. In the embodiments of the invention the energy beam is a pulsed laser beam. The pulsed laser beam may consist of pre-pulse and main-pulse, with parameters such as laser pulse repetition rate chosen in order to suppress debris. In other embodiments the energy beam is the electron beam produced by an electron gun and the rotating target assembly is a rotating anode.

20 Claims, 12 Drawing Sheets

(58) Field of Classification Search
USPC ..... 250/493.1, 503.1, 504 R
See application file for complete search history.

$\overrightarrow{V_R} = 0$ $$|\vec{V}_R| > |\vec{V}_{d0}|[sin(\gamma/2) + \cos(\gamma/2)\tan(\alpha/2)]/(2\pi R)$$

2nd test

3rd test

4th test

HIGH BRIGHTNESS SHORT-WAVELENGTH RADIATION SOURCE (VARIANTS)

CROSS-REFERENCE TO RELATED APPLICATIONS

Current patent application claims priority to the Russian patent application RU2019113052 filed on Apr. 26, 2019 and is a continuation in part of U.S. patent application Ser. No. 16/103,243 filed on Aug. 14, 2018, all of which incorporates herein by reference in their entirety.

FIELD OF INVENTION

The invention refers to high brightness radiation sources designed to generate X-ray and vacuum ultraviolet (VUV) radiation at wavelengths of approximately 0.01 to 200 nm, which provide highly effective debris mitigation in the path of the short-wavelength beam to ensure the long-term operation of the radiation source and its integrated equipment. Applications include X-ray and VUV metrology, microscopy, X-ray material diagnostics, biomedical and medical diagnostics, and various types of controls, including inspection of lithographic EUV masks.

BACKGROUND OF INVENTION

High-intensity X-ray and VUV sources are used in many fields: microscopy, materials science, biomedical and medical diagnostics, materials testing, crystal and nanostructure analysis, atomic physics, and lithography. These sources are the basis of the analytical base of modern high-tech production and one of the main tools in the development of new materials and products based on them.

The implementation of X-ray diagnostic methods requires compact, high-brightness X-ray sources, characterized by reliability and long lifetime. Depending on the applications, which include: visualization and 3D-reconstruction of the internal structure of organic and inorganic objects, high-contrast imaging of small organic objects, accurate determination of nanostructure parameters of materials—the spectrum energy should be in the range from 100 to 6 keV (from ~0.01 to 0.15 nm), that is, in the range of hard X-rays. In this range, radiation is most effectively generated by direct conversion of electron beam energy into braking and characteristic radiation.

Obtaining radiation in soft X-ray (0.4-10 nm) and VUV (10-200 nm) ranges is most effective with the help of laser-produced plasma light sources. Their development in recent years has been largely stimulated by the development of projection extreme ultraviolet (EUV) lithography for high-volume manufacturing of integrated circuits (ICs) with 10-nm node and below.

EUV lithography is based on the use of radiation in the range of 13.5+/−0.135 nm, corresponding to the effective reflection of multi-layer Mo/Si mirrors. One of the most important metrological processes of modern nanolithography is the control of ICs for the absence of defects. The general trend in lithographic production is a shift from ICs inspection to the analysis of lithographic masks. The process of mask inspection is most effectively carried out with the help of its scanning by actinic radiation, i.e. radiation, the wavelength of which coincides with the working wavelength of the lithograph (the so-called Actinic Inspection). Thus, the control of lithographic mask defect-free production and operation is one of the key problems of lithography, and the creation of a device for the diagnosis of lithographic masks and its key element, the high-brightness actinic source, is one of the priorities of the development of EUV lithography.

The radiation sources for EUV lithography are using Sn-plasma generated by a powerful laser system including $CO_2$ lasers. Such sources have the power of EUV radiation exceeding by several orders of magnitude the level of power required for the inspection of EUV masks. Therefore, their usage for mask inspection is inadequate due to the excessive complexity and cost. In this regard, there is a need for other approaches to the creation of high-brightness EUV sources for actinic inspection of EUV masks.

In accordance with one of the approaches known from the patent application US20020015473, published on Feb. 7, 2002, sources for the generation of high brightness X-ray or EUV radiation are known, including a liquid-metal-jet target supplied to the electron beam interaction zone.

Sources of this type are characterized by compactness and high output radiation stability. Due to the large contact area of the liquid metal with the cooling surface of the heat exchanger, a rapid decrease in the target temperature is achieved. Thus, it is possible to obtain a high energy density of the electron beam on the target and provide a very high spectral brightness of the source of X-ray or EUV radiation. Thus, liquid-metal jet X-ray sources have a brightness much higher than X-ray sources with a solid rotating anode and the use of liquid metal as a coolant, known, for example, from the U.S. Pat. No. 7,697,665, issued Apr. 13, 2010.

However, the circulation system of the jet liquid metal target is quite complex, which complicates the overall design of the radiation source. Also, these sources of radiation are characterized by the problem of contamination of the exit window, through which the beam of short-wavelength radiation is released. In the X-ray sources with a liquid-metal-jet anode, the intensive generators of debris are the nozzle and trap of liquid-metal jet, from which the fog from microdroplets of the target material spreads. As a result, the power of the radiation source decreases the faster the greater the power of the electron beam.

Part of this disadvantage is ameliorated in the high brightness liquid-metal jet X-ray source known from the U.S. Pat. No. 8,681,943, issued Mar. 25, 2014, in which an X-ray beam leaves the vacuum chamber through an exit window (preferably made of beryllium foil), equipped with a protective film element with a system of evaporative cleaning. The liquid metal preferably belongs to the group of low-melting metals, such as indium, tin, gallium, lead, bismuth, or their alloys.

However, the temperatures required for evaporative cleaning are high, e.g. about 1000° C. and more, for evaporation of Ga and In, which complicates the device.

Debris particles generated as a by-product during the operation of a radiation source may be in the form of high-energy ions, neutral atoms and clusters, or microdroplets of the target material.

The magnetic mitigation technique disclosed, for example, in the U.S. Pat. No. 8,519,366, issued Aug. 28, 2013, is arranged to apply a magnetic field so that charged debris particles are mitigated. In this patent the debris mitigation system for use in a short-wavelength radiation source, includes a rotatable foil trap and gas inlets for the supply of buffer gas to the foil trap so that neutral atoms and clusters of target material are effectively mitigated.

However, these methods do not provide highly effective suppression of the microdroplet fractions of debris particles in the path of the short-wavelength radiation beam. This limits the uptime of the equipment, in which the radiation source is affected due to the contamination of its optical elements.

Another debris mitigation technique, known from the U.S. Pat. No. 7,302,043, issued on Nov. 27, 2007, is arranged to apply a rotating shutter assembly configured to permit the passage of short-wavelength radiation through at least one aperture during the first period of rotation, and to thereafter rotate the shutter to obstruct passage of the debris through at least one aperture during the second period of rotation.

However, the complexity of using these debris-mitigation techniques in a compact radiation source means that technically they are too difficult to implement.

From the U.S. Pat. No. 9,897,930, issued on Feb. 20, 2018, it is known that a membrane from carbon nano tubes (CNT) having thickness more than 20 nm and high transparency for EUV radiation is used as a mask pellicle within the lithographic apparatus. It was proposed also to use CNT-membrane as a debris trapping system for EUV lithography source.

CNT-membranes are characterized by a number of advantages, including low cost and high strength, which allows them to be produced free-standing at large (centimeter) sizes, as is known, for example, from the publication of M. Y. Timmermans, et al. "Free-standing carbon nanotube films for extreme ultraviolet pellicle application", Journal of Micro/Nanolithography, MEMS, and MOEMS 17(4), 043504 (27 Nov. 2018).

However, the use of a CNT-membrane for trapping debris particles generated by EUV lithography source is unlikely, as the CNT-membrane is highly likely to be destroyed by such powerful radiation. For less powerful sources of radiation, there is also a limitation. As our research has shown, a small fraction of debris particles with microdroplet sizes of more than 300 nm can penetrate through the CNT-membrane, which does not ensure the purity of the short-wavelength radiation source only through the use of a CNT-membrane.

SUMMARY

The technical problem to be solved by the invention relates to the creation of compact sources of high brightness X-ray and VUV radiation with mitigation of the flow of debris particles in the path of the short-wavelength radiation beam used.

Achievement of the purpose is possible by means of a high-brightness short-wavelength radiation source, containing a vacuum chamber with a rotating target assembly supplying a target into an interaction zone; an energy beam focused on the target in the interaction zone; and a useful short-wavelength radiation beam coming out of the interaction zone.

The source is characterized in that the rotating target assembly is made with an annular groove, the target is a layer of target material being molten metal formed by a centrifugal force on a surface of the annular groove facing a rotation axis, and the energy beam is either a pulsed laser beam or an electron beam.

In a preferred embodiment of the invention, the rotating target assembly is a disk with a peripheral part in a form of a ring barrier, on an inner surface of which, facing the axis of rotation, there is the annular groove with a surface profile preventing a release of the target material in a radial direction and in both directions along the axis of rotation.

In the embodiment of the invention, the short-wavelength radiation is generated by the energy beam heating the target material to a plasma-forming temperature.

In another embodiment, the energy beam is the electron beam, the rotating target assembly is a rotating anode of an electron gun, and the short-wavelength radiation is an X-ray radiation generated by an electron bombardment of the target.

In a preferred embodiment of the invention, the target material is selected from fusible metals, including Sn, Li, In, Ga, Pb, Bi, Zn and their alloys.

In an embodiment of the invention, a replaceable CNT-membrane is installed in a line-of-sight of the interaction zone, completely covering an aperture of the short-wavelength radiation beam.

In another aspect, the invention relates to a high-brightness short-wavelength radiation source, comprising a vacuum chamber with a rotating target assembly supplying a target into the interaction zone with a pulsed laser beam focused onto the target, which is a molten metal layer formed by a centrifugal force on a surface of an annular groove, implemented in the rotating target assembly, and means for debris mitigation on the path of the short-wavelength radiation beam output.

The source is characterized in that the linear velocity of the target is high enough, more than 20 m/s, to influence the direction of the predominant output of microdroplet fractions of debris particles from the interaction zone, a direction of a short-wavelength beam output from the interaction zone is different from the direction of the predominant output of the microdroplet fractions of debris particles, a replaceable CNT membrane with high, more than 50% transparency in a wavelength range shorter than 20 nm, transmission is installed in the line-of-sight of the interaction zone, completely covering an aperture of the short-wavelength radiation beam.

In an embodiment of the invention, the target material is tin or its alloy, the linear velocity of the target is large enough, more than 80 m/s, to suppress the output in the direction of the CNT membrane of the microdroplets with a size of more than 300 nm, which are capable of penetrating through the CNT membrane.

In a preferred embodiment of the invention, one or more debris mitigation techniques such as electrostatic and magnetic mitigation, protective gas flows and foil traps are additionally used.

In an embodiment of the invention, the CNT membrane is coated on a side outside the line-of-sight of the interaction zone.

In an embodiment of the invention, the CNT membrane serves as a window between compartments of the vacuum chamber with high and medium vacuum.

In an embodiment of the invention, the pulsed laser beam consists of two parts: pre-pulse laser beam and main-pulse laser beam, parameters of which are chosen so as to suppress the fast ions fraction of the debris particles.

In the embodiment of the invention, a ratio of the pre-pulse laser beam energy to that of main-pulse is less than 20% and a time delay between the pre-pulse and the main-pulse is less than 10 ns.

In the embodiment of the invention, a laser pulse repetition rate is high enough to provide high-efficient evaporation of microdroplet fractions of debris particles of the previous pulse by both short-wavelength radiation and fluxes of laser-produced plasma.

In yet another aspect, the invention relates to a high brightness X-ray source with a rotating anode, containing a vacuum chamber in which an electron beam produced by an electron gun is directed to an interaction zone with a target, which is a layer of target material being molten metal formed by a centrifugal force on a surface of an annular groove of the rotating anode.

In an embodiment of the invention, the X-ray source contains means for debris mitigation.

In the embodiment of the invention, a CNT membrane is installed on the path of the X-ray beam output.

In an embodiment of the invention, the rotating anode is equipped with a liquid cooling system.

In an embodiment of the invention, the size of the focal spot of the electron beam on the target is less than 50 microns.

In an embodiment of the invention, the linear velocity of the target is more than 80 m/s.

The technical result of the invention is the creation of X-ray and VUV radiation sources of high brightness with mitigation of the debris particles on the path of the passing beam of the short-wavelength radiation, characterized by increased service life, ease of operation and lower operating costs.

The advantages and features of the present invention will become more apparent from the following non-limiting description of exemplary embodiments thereof, given by way of example with reference to the accompanying drawings.

BRIEF DESCRIPTION OF THE DRAWINGS

The essence of the invention is explained by the drawings, in which.

In the drawings, the matching elements of the device have the same reference numbers.

These drawings do not cover and, moreover, do not limit the entire scope of options for implementing this technical solution, but are only illustrative examples of particular cases of its implementation.

DETAILED DESCRIPTION OF THE PREFERRED EMBODIMENTS OF THE INVENTION

Figure 1:
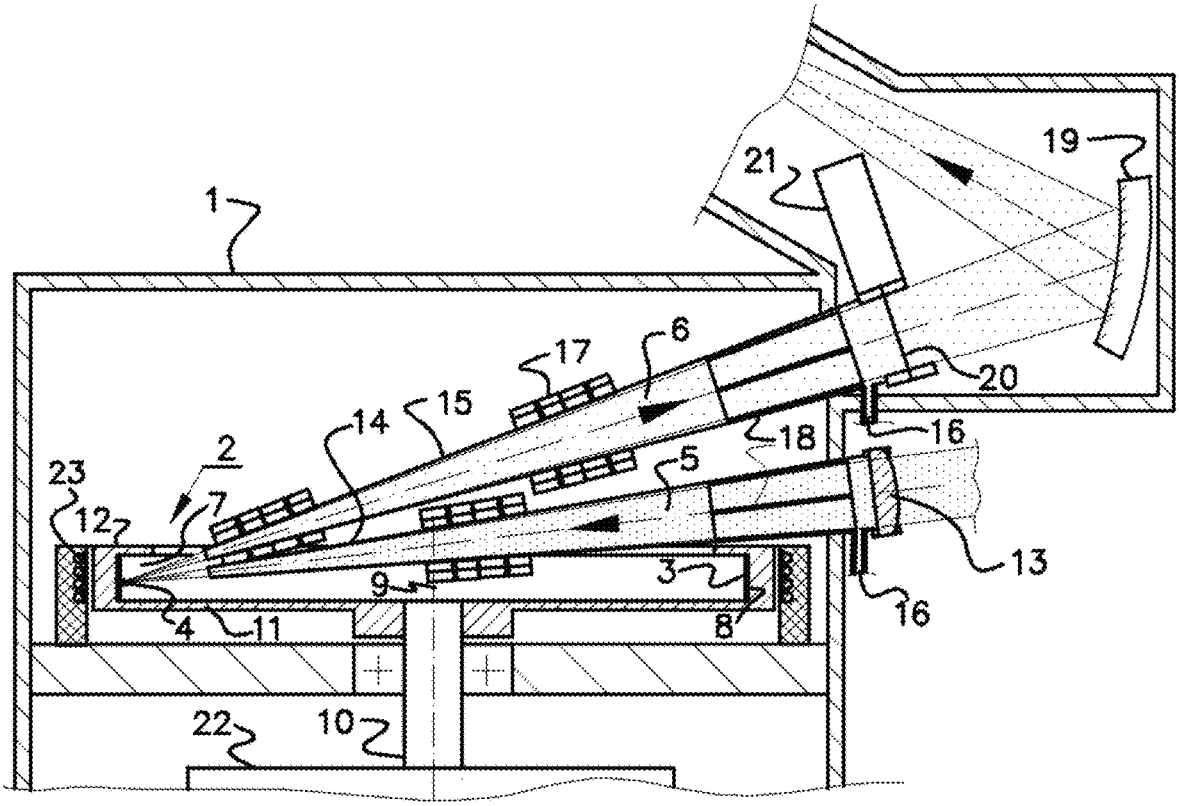
FIG. 1—Schematic diagram of high brightness short-wavelength radiation source in accordance to the present invention, FIG. 2—Transmission spectrum of CNT-membrane, FIG. 3A, FIG. 3B—schematically show the mechanism of mitigating the microdroplet fractions of debris particles due to the high linear velocity $V_R$ of a rotating target, FIG. 4—Simplified schematic of a high brightness short-wavelength radiation source in accordance with the embodiment of this invention, FIG. 5 Tests results for microdroplets mitigation in the EUV source, FIG. 6A, FIG. 6B, FIG. 6C—SEM images, demonstrating achievement of debris mitigation effect in the high brightness EUV source made in accordance with the present invention, FIG. 7, FIG. 8, FIG. 9—Illustrations of debris mitigation using laser pre-pulse, FIG. 10—Illustration of the debris mitigation mechanism due to the high repetition rate of laser pulses, FIG. 11—Schematic diagram of the high brightness X-ray source in accordance with this invention, FIG. 12—Schematic of high-brightness X-ray source in accordance with an embodiment of the present invention.

In accordance with the example of the invention shown in FIG. 1, a high brightness source of short-wavelength radiation contains: a vacuum chamber 1 with a rotating target assembly 2, supplying target 3 in the interaction zone 4. In the vacuum chamber 1, an energy beam 5 is focused on the target in the interaction zone 4. The short-wavelength radiation generated in the interaction zone 4, intended for use, leaves the interaction zone 4 in the form of a useful beam of short-wavelength radiation 6. Rotating target assembly 2 is made with an annular groove 7, and target 3 is a layer of molten metal formed by centrifugal force on the surface 8 of the annular groove, facing the axis of rotation 9. The energy beam 5 is either an electron beam or a pulsed laser beam. For simplification, the energy source emitting the energy beam 5 on FIG. 1 is not shown.

At a sufficiently large centrifugal force, the surface of the liquid metal target 3 is parallel to the axis of rotation 9 and is circular-cylindrical, FIG. 1. For the formation of a target, the rotating target assembly 2 is made preferably in the form of a disk 11 fastened to a rotation shaft 10 having a peripheral part in the form of an annular barrier or a side 12. On the inner surface of the annular barrier 12, facing the axis of rotation 9, there is an annular groove 7. Annular groove 7 is made with the function of preventing the ejection of target material 3 in the radial direction and in both directions along the axis of rotation 9. The volume of material of the liquid metal target 3 is not more than the volume of the annular groove 7. The surface of the groove can be formed by a cylindrical surface 8, facing the axis of rotation 9, and two radial surfaces, as shown in FIG. 1, not limited to this option.

In the embodiments of the invention the short-wavelength radiation is generated by the energy beam heating the target material to a plasma-forming temperature and the energy beam 5 is either an electron beam or a pulsed laser beam.

FIG. 1 illustrates an embodiment of the invention in which the energy beam is a pulsed laser beam 5. Preferably, the laser is placed outside the vacuum chamber, and the laser beam 5 is introduced through its input window 13. In these embodiments of the invention, the short-wavelength radiation is generated by a high-temperature laser-produced plasma of the target material in one or more spectral ranges, which include VUV, EUV, soft X-ray, and X-ray.

The useful short-wavelength radiation leaves the interaction zone 4 in the form of a divergent beam of short-wavelength radiation 6. For the short-wavelength beam 6, as well as the energy beam 5, there are means of debris mitigation. Preferably, they contain casings 14, 15 which surround the energy beam 5 and the short-wavelength beam 6, gas inlets 16 providing directional gas flows, sources of magnetic field, for example, in the form of permanent magnets 17, sources of electrostatic field (not shown), foil traps 18, and/or shields (not shown).

The equipment using short-wavelength radiation may include a collector mirror 19 located in the clean optical compartment of vacuum chamber 1.

In order to control the direction of microdroplets exiting from the interaction zone 4, the linear velocity of the target should be quite high, more than 20 m/s. Due to this, the predominant direction of microdroplets exiting becomes close to tangential. Therefore, to suppress the debris particles in the short-wavelength beam 6, its direction is chosen to be significantly different from the direction of the predominant output of the microdroplets, which ensures the purity of the short-wavelength radiation source.

At the same time, the means of debris mitigation include a replaceable CNT-membrane 20 with a high, more than 50%, transparency in the range of wavelengths shorter than 20 nm, installed in the line of sight of the interaction zone 4 and completely covering the aperture of the short-wavelength beam 6, FIG. 1. The CNT membrane is an optical element in the form of a free-standing CNT film fixed on a frame, which has high strength, a sufficiently low absorption of radiation with a wavelength shorter than 20 nm and can be coated or filled to extend the service life or give other properties.

In order to change the CNT-membrane 20, a node 21 is inserted for replacing the CNT-membrane replacement, for example, of the turret type, which can be driven from outside of the vacuum chamber 1, for example, driven through a magnetic coupling, or through a gland, or through a miniature stepper motor installed in the vacuum chamber, is introduced, not limited only to these options.

Figure 2:
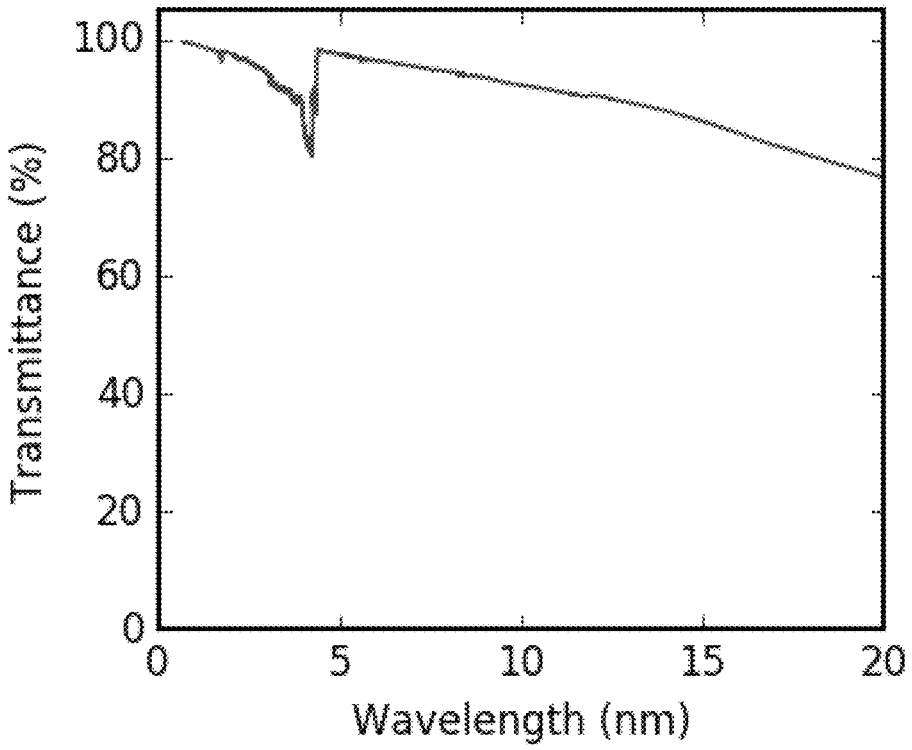

The CNT-membrane preferably has a thickness in the range of 20 to 100 nm, which ensures its high transparency in the range of wavelengths shorter than 20 nm, as illustrated in FIG. 2, which shows the transmission spectrum of the CNT-membrane with a thickness of about 100 nm measured using synchrotron radiation. It can be seen that in this range, the transparency exceeds 75%, amounting to about 90% at a wavelength of 13.5 nm. At the same time, the CNT-membrane can serve as a spectral filter that cuts off unwanted radiation, for example, as part of the laser radiation scattered in the interaction zone.

In addition, the CNT-membrane can serve as a solid base on which the coating is applied, for example, a metal foil that serves as a spectral purity filter, narrower in comparison with the CNT-membrane.

The high durability of the CNT-membrane is one of its undoubted advantages. CNT-membrane samples with a diameter of 5 mm and a thickness of 90 nm have the following characteristics. Viscoelastic state, elastic deformation range up to $\Delta P=120$ Pa, burst pressure $\Delta P=5.5$ kPa, biaxial modulus of elasticity—15 GPa, ultra-low gas permeability, heat load −2500° C. in high vacuum without any changes in characteristics.

In the embodiments of the invention, on one side of the CNT-membrane, a support grid with high, up to 98%, geometric transparency can be placed. In other embodiments, the CNT-membrane can be placed between two identical grids with high, up to 98%, geometric transparency, located without displacement relative to each other. It allows an increase in durability without a noticeable decrease in transparency, as well as an increase in the area of the CNT-membrane, thereby reducing the rate of its contamination and increasing its service life.

Due to its high strength and low permeability, the CNT-membrane can be used as an output window or a gas lock, for example, between the compartments of the vacuum chamber with medium and high vacuum. Thus, FIG. 1 shows a variant in which the CNT-membrane 20 serves as an output window of a short-wavelength radiation source and a gas gate or lock between the casing 15 and a clean optical compartment of the vacuum chamber with a higher vacuum, in which the collector mirror 19 is placed. At the same time, protective flows of inert buffer gas directed from both the CNT membrane 20 and input window 13 to the interaction zone 4 are supplied by means of gas inlets 16.

The operation of a high brightness short-wavelength radiation source is performed as follows. Vacuum chamber 1 is evacuated with an oil-free pump system to below $10^{-5}$-$10^{-8}$ bar, thus removing gas components such as nitrogen and carbon which are capable of interacting with the target material.

The target material preferably belongs to the group of non-toxic fusible metals, including Sn, Li, In, Ga, Pb, Bi, Zn and their alloys. The target material is preferably kept molten using a fixed inductive heating system 23, configured to permit temperature stabilization of target material in order to keep it within the optimal temperature range.

The rotating target unit 2 is driven by a rotary drive 22, e.g. an electric motor with a magnetic coupling, which ensures the cleanliness of the vacuum chamber 1. Due to centrifugal force, the target 3 is formed as a layer of target material being molten metal on the surface of the annular groove 7 facing the axis of rotation 9 of the surface 8.

The target 3 is exposed to the energy beam 5, focused on the target in the interaction zone 4. In an embodiment of the invention (FIG. 1), the energy beam 5 is a pulsed laser beam acting with high pulse repetition rate, which can be in the range from 1 kHz to 20 MHz. Shortwave radiation is generated in VUV (10-200 nm) and/or soft X-ray (0.4-10 nm) bands by the laser-produced plasma of the target material.

Heat dissipation is carried out through a narrow (~0.1-0.2 mm) gap between the rotating target assembly 2 and a stationary water-cooled radiator (not shown) through which the gas is blown at a pressure of ~1 mbar. The thermal conductivity of the gas and the contact area is sufficient to remove up to 3 kW of thermal power for this type of cooling. However, other ways of cooling the rotating target assembly can be used.

From the dense high-temperature laser-produced plasma generated in the interaction zone 4, the output is the useful short-wavelength radiation beam 6.

Preferably, the radiation output passes through the CNT-membrane 20, which is installed in the line of sight of the interaction zone 4, completely covering the aperture of the short-wavelength radiation beam 6. CNT-membrane 20 allows the passage of the output of the short-wavelength beam with wavelengths shorter than 20 nm, FIG. 2. At the same time, CNT-membrane 20 provides highly effective debris trapping in the path of propagation of the beam of short-wavelength radiation.

In the embodiments of the invention, debris mitigation techniques such as electrostatic and magnetic mitigation, foil traps, combining high radiation transparency and a large surface area for the deposition of debris particles, and protective buffer gas flows are used. In accordance with this, gas flows inside the stationary casings 14, 15 prevent plasma and vapor of the target material from moving towards the CNT-membrane 20 and the input window 13, thus protecting them from contamination, FIG. 1. Charged particles are also deposited on the surface of the casings 14, 15 and/or foil traps 18 by means of a magnetic field created by permanent magnets 7 located on the outer surface of the casings 14, 15. The magnetic fields are oriented preferably across the axis of laser beam 7 and short-wavelength radiation beam 9 to prevent plasma from moving towards the CNT-membrane 20 and input window 13.

An important component of the debris mitigation system in accordance with this invention is the use of a high linear velocity of the target, more than 20 m/s. Due to this, the microdroplet fraction of the debris particles has a significant tangential component of the velocity. At the same time, the output of the short-wavelength radiation beam 6 has a direction different from the direction of the predominant output of the microdroplets.

Figure 3A:
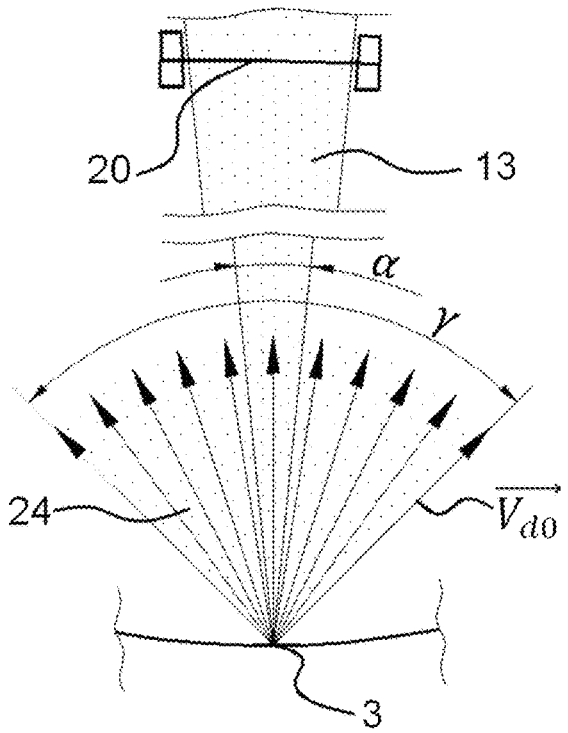
Figure 3B:
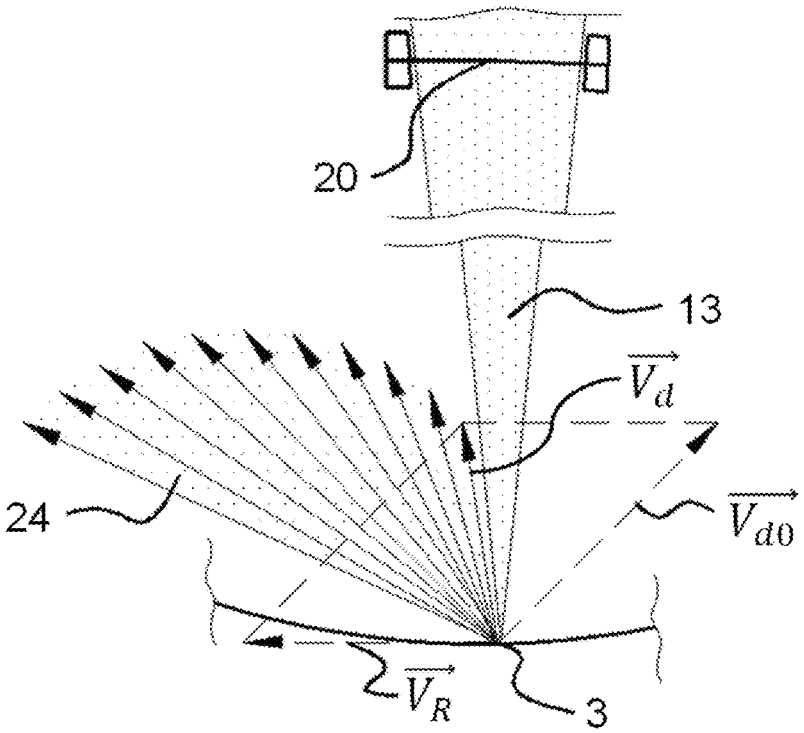

The mechanism of suppressing the flow of the microdroplet fraction of the debris particles in the direction of the CNT-membrane due to the high linear velocity of the target $V_R$ is schematically illustrated in FIG. 3A, FIG. 3B, which present diagrams of the escape velocity $V_d$ of the microdroplets for different $V_R$. When the linear velocity of target 3 is zero: $V_R=0$, the characteristic microdroplet escape velocity is $V_{d0}$, the short-wavelength beam 6 is characterized by a collection angle $\alpha$ while flow 24 of the microdroplet fraction is characterized by the total escape angle $\gamma$. As can be seen from FIG. 3A, at $V_R=0$ the flow 24 of the microdroplet fraction of the debris particles is directed towards the CNT-membrane 20.

In the case when a sufficiently large component of the linear velocity of the target $\vec{V}_R$ is added to the velocity vector $\vec{V}_{d0}$ of each drop, the flow 24 of the microdroplet fraction of the debris particles is not directed towards the CNT membrane 20, as can be seen in FIG. 3B.

The condition that the flow of the microdroplet fraction is not directed to the CNT-membrane 20, as well as the input window 13, FIG. 3, can be estimated from the following expression:

$$|\vec{V}_R| \geq |\vec{V}_{d0}|[\sin(\gamma/2)+\cos(\gamma/2)\tan(\alpha/2)] \quad (1)$$

In an embodiment of the invention, the material of the target is tin (Sn) or its alloy, which provides both high brightness and high optical output in the spectral range (13.5+/−0.135) nm, as more than a hundred lines of tin ion radiation with a charge from +6 to +11 fall within the specified wavelength range. For this target material, the characteristic escape velocity of the droplet fractions is about 100 m/s or less: $V_{d0} \leq 100$ m/s. For the collection angle $\alpha=24°$, the total escape angle $\gamma=90°$ and the characteristic radius of the target orbital circle R=0.1 m, the linear velocity of the target $V_R$ with the expression (1) should be 80 m/s or higher. Accordingly, in the embodiment of the invention, the linear velocity of the target is chosen to be sufficiently high, more than 80 m/s, to repeatedly, compared with lower linear velocities, reduce the microdroplets escape in the direction of the CNT-membrane 20.

It should be noted that the highly effective use of the CNT-membrane 20 for final cleaning of the short-wavelength radiation beam 6 is achieved due to deep suppression of the flow of debris particles in its direction. This provides a long service life of the CNT-membrane 20, determined, first of all, by the rate of reduction of its transparency due to the deposition of debris particles. Particularly important is the suppression of debris particles in the form of microdroplets with a size of more than 300 nm, which, although with a low probability, can penetrate into the CNT-membrane or even through it, due to its high energy.

After reducing the transparency of the CNT-membrane to a certain predetermined value, it is replaced by the replacement node 21. A compact CNT-membrane replacement node can be a revolving or carousel type with a magazine that accommodates the number of replaceable CNT-membranes required for the lifetime of the radiation source. The CNT-membrane replacement node 21 can be driven from outside the vacuum chamber 1, for example, through a magnetic coupling, or through a gland, or through a miniature mechanism with a stepper motor installed in the vacuum chamber, not limited to these options.

Figure 4:
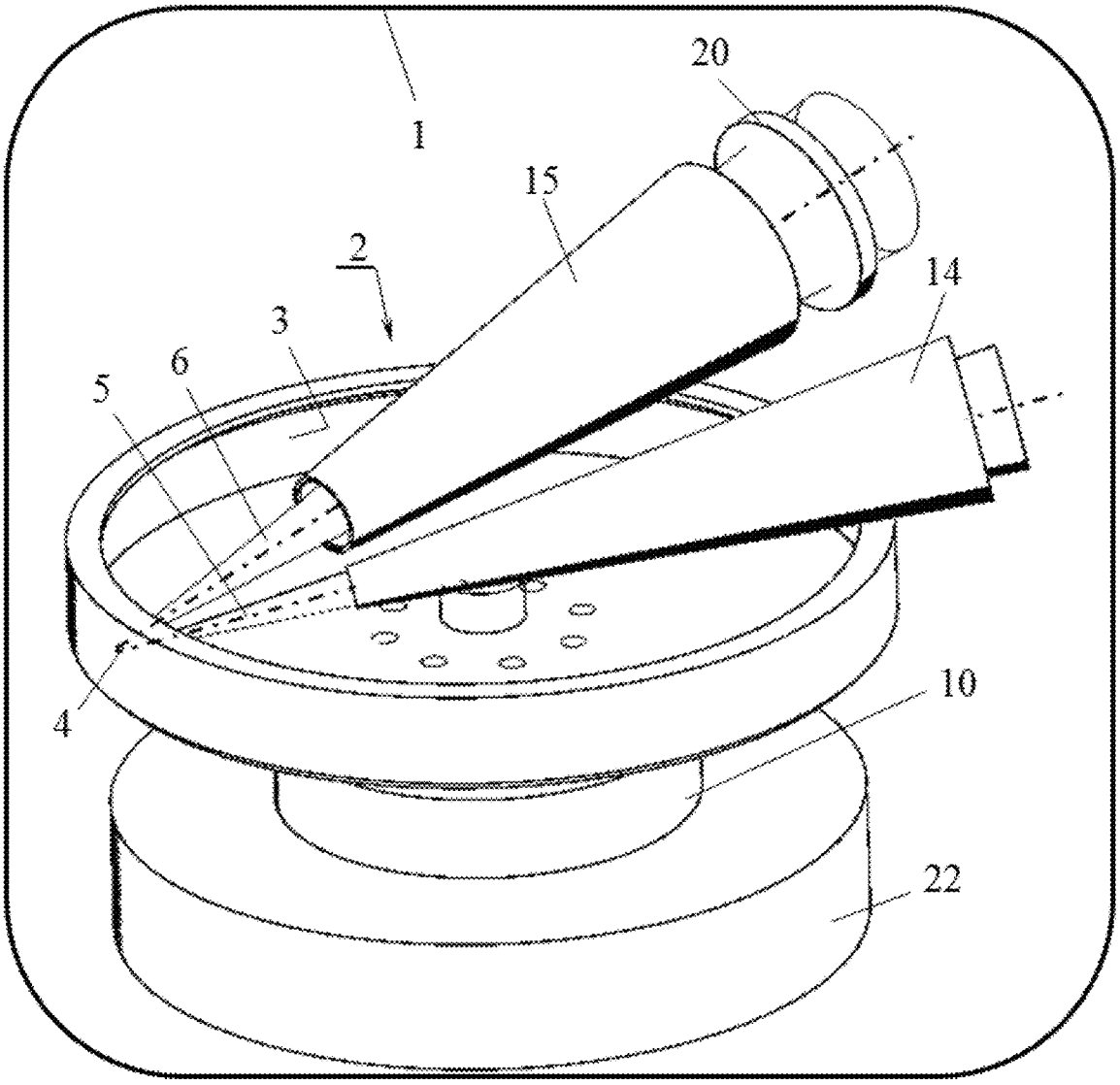

FIG. 4 presents a simplified diagram of a short-wavelength radiation source according to the implementation of this invention. In contrast to the design variant shown in FIG. 1, the energy beam 5 and the short-wavelength beam 6 are located on both sides of the plane passing through the axis of rotation 9 and the interaction zone 4. Other parts of the device in this embodiment are the same as in the above embodiments (FIG. 1), have the same item numbers in FIG. 4, and their detailed description is omitted.

An embodiment of the invention in accordance with the diagram FIG. 4 was used to test the debris mitigation measures in the EUV source. The energy beam 5 was a pulsed laser beam, and short-wavelength radiation was generated by a high-temperature laser-produced plasma. During the tests on the path of the short-wavelength beam 6, a replaceable witness sample (not shown) made of a mirror-polished silicon (Si) witness sample was installed.

The characteristic test parameters were as follows:

- the target radius of rotation—0.1 m.
- linear target velocity—from 20 to 120 m/s
- distance from the interaction zone to the Si-witness sample—0.44 m
- target material—eutectic alloy Sn/In at temperatures above 120° C.
- exposure time—5 hours or $1.08 \cdot 10^9$ pulses
- wavelength, energy, duration and frequency of laser pulses respectively—1.06 μm, 0.44 mJ, 1.85 ns, 60 kHz.

Using a scanning electron microscope (SEM), the quantity and size of the debris particles deposited on the surface of the witness sample was calculated and determined.

In addition to the debris mitigation due to the rapid rotation of the target, it was also possible to use such debris mitigation techniques as magnetic mitigation and protective buffer gas flow.

The following tests were carried out:

- 1st test: $V_R=24$ m/s, no other debris mitigation techniques are used,
- 2nd test: $V_R=24$ m/s, other debris mitigation techniques are used,
- 3rd test: $V_R=120$ m/s, other debris mitigation techniques are used except for the CNT-membrane,
- 4th test: $V_R=120$ m/s, all debris mitigation techniques, including a CNT-membrane, are used.

In the first three tests the witness sample was installed instead of the CNT-membrane 20, in the fourth test the witness sample was installed closely behind the CNT-membrane 20.

Figure 5:
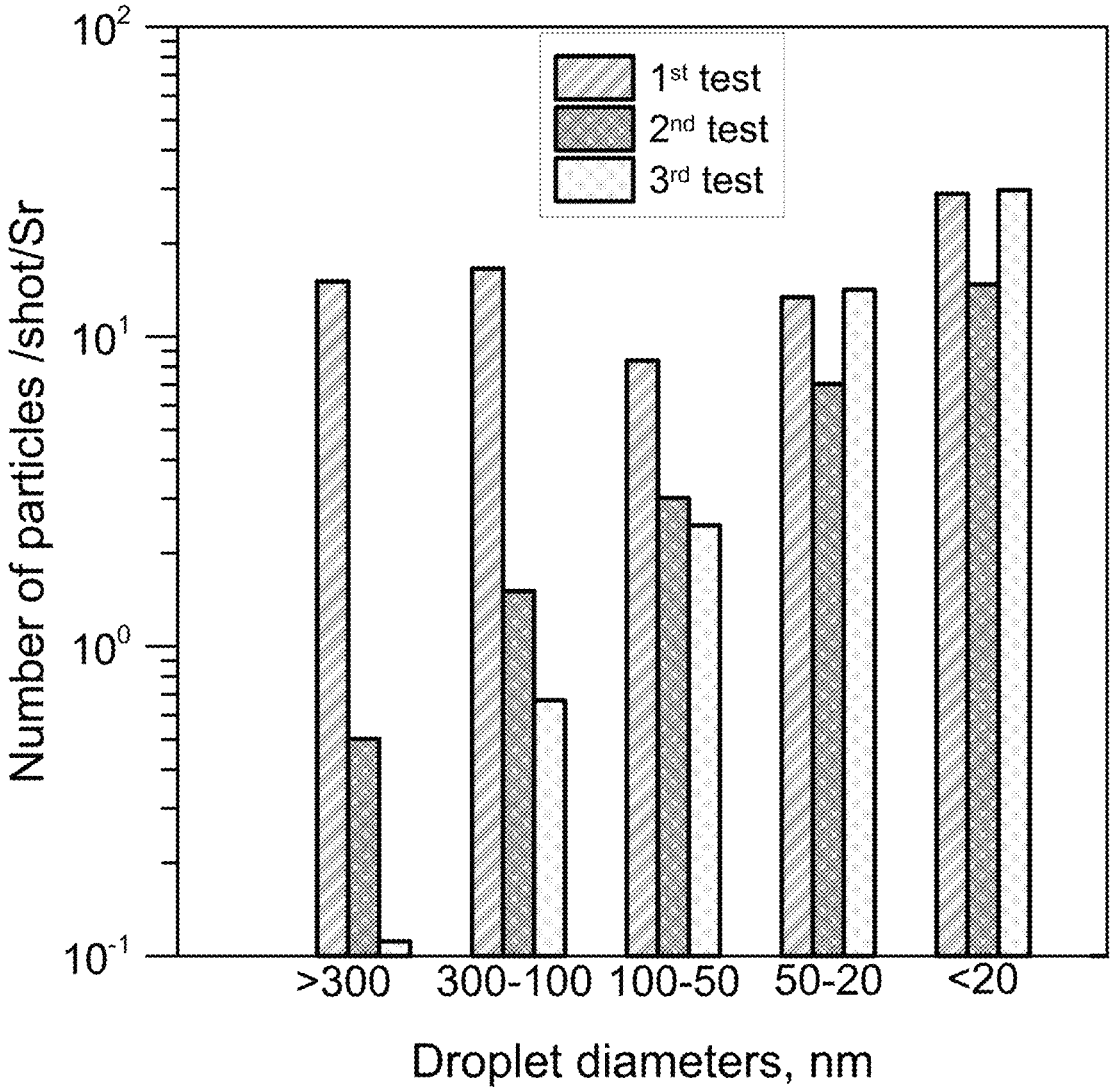

FIG. 5 shows the results of measuring the quantity and size distribution of the microdroplets obtained in the 1st, 2nd and 3rd tests.

The results of the 1st test show that at low linear velocity without other debris mitigation techniques, microdroplets with a diameter of more than 300 nm play a major role in the deposition of Sn/In target material on the witness sample. During a week-long cycle of continuous operation, microdroplets of all sizes would cover more than 100% of the test specimen surface.

The results of the 2nd test show that the use of magnetic field and buffer gas flow were highly effective in suppressing debris such as ions and target material vapors, while the number of microdroplets with diameters greater than 300 nm is approximately 50 times less than the first test. Recalculation of the results shows that for a week-long cycle of continuous operation, microdroplets of all sizes would cover about 4% of the surface of the witness sample.

High rotation speed practically fully eliminates 300+ nm droplets. This fact is of importance for the use of an additional membrane for ultimate EUV cleaning.

The results of the 3rd test show that a high ($V_R=120$ m/s) target velocity practically fully eliminates 300+ nm microdroplets. This fact is important for highly efficient use of CNT-membranes for ultimate EUV cleaning. Recalculation of the results shows that for a week-long cycle of continuous operation, microdroplets of all sizes would cover only about 0.7% of the surface of the witness sample.

Figure 6A:
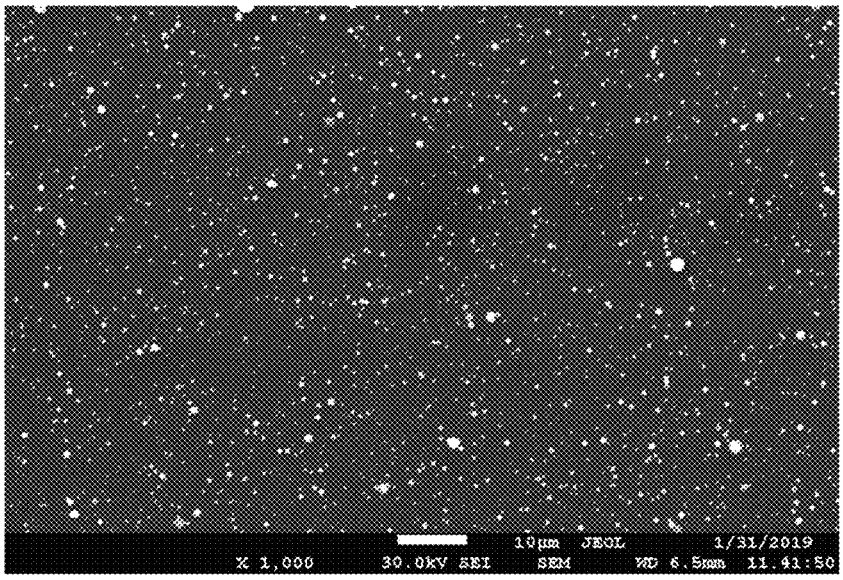
Figure 6B:
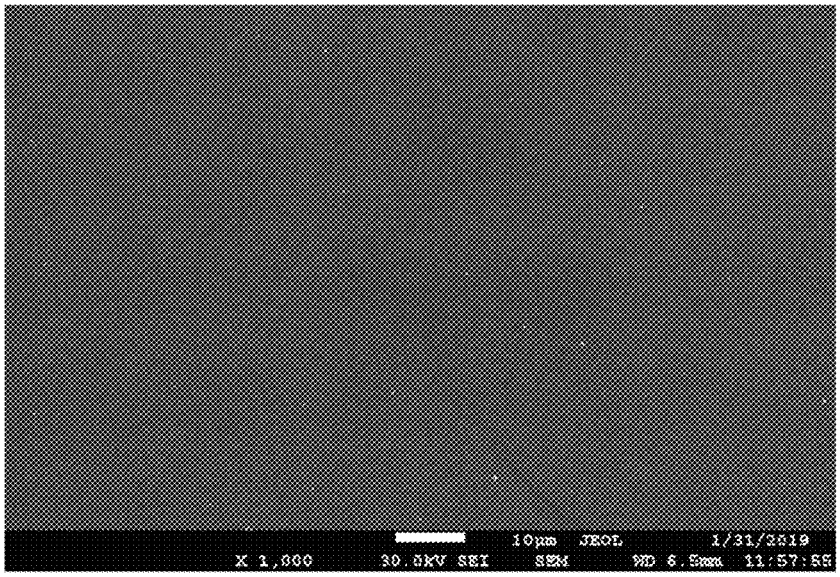
Figure 6C:
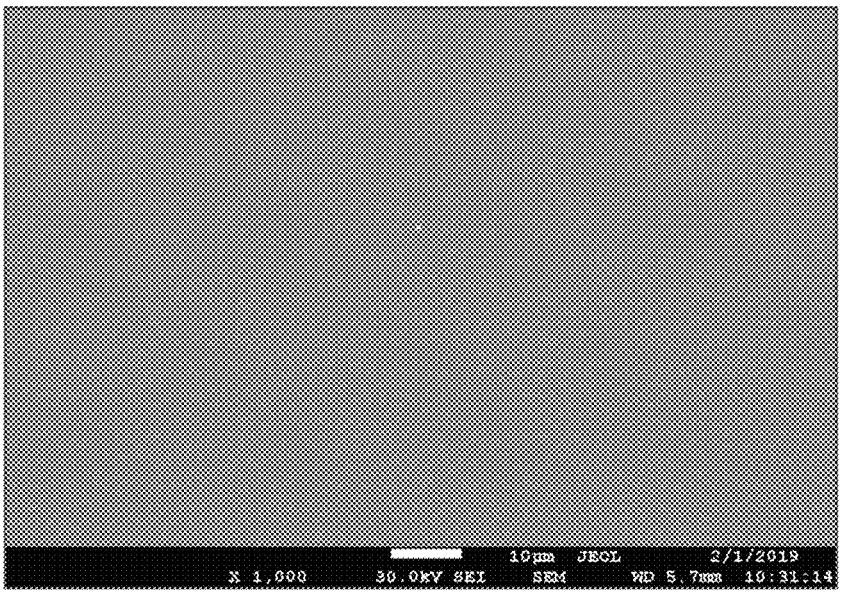

FIG. 6A, FIG. 6B, FIG. 6C show SEM images of the witness samples obtained in the 2nd, 3rd, and 4th tests. In the 4th test the conditions were the same as in the 3rd test, but a CNT-membrane 20 in front of the witness sample. It can be seen that a low speed of rotation leads to a noticeable contamination of the sample, FIG. 6A. An increase in the linear target velocity from 24 to 120 m/s leads to a sharp increase in debris mitigation, FIG. 6B. Test results when using a CNT-membrane showed that ions and vapors of the target material do not penetrate through it. Only single microdroplets of about 400 and 500 nm in size penetrated the membrane, which indicates almost ultimate EUV beam cleaning, FIG. 6C.

Another result of the 4th test was the fact that the microdroplet deposition on the Si-witness sample is 45 times greater than on the CNT-membrane. This indicates that most of the microdroplets are reflected from the CNT-membrane, which is caused by non-wetting properties and high elasticity of the surface layer of the CNT-membrane. Therefore, in the case of presence of metallic or other such coatings on the CNT-membrane 20, it is preferably located on the side that is outside the line of sight of the interaction zone 4.

Based on the performed tests, it is estimated that microdroplets of more than 300 nm penetrate through the membrane with the probability of $P_{>300}$, not exceeding 0.005: $P_{>300} \leq 0.005$. The measured S deposition rate of microdroplets of this type on the CNT-membrane corresponds to the coverage of $4 \cdot 10^{-5}$ surfaces per weekly cycle of continuous operation. Accordingly, for a mirror 19 behind the CNT-membrane (FIG. 1), the rate of reflectivity loss due to the deposition of microdroplets of this size is estimated at $S \cdot P_{>300} \leq 2 \cdot 10^{-7}\%$ per week of continuous operation. In other words, the degradation of 5% of the mirror surface behind the membrane is estimated to require $5 \cdot 10^{6}$ hours of continuous operation of the EUV source.

The probability of $P_{<300}$ microdroplets with a diameter of less than 300 nm passing through the CNT membrane was estimated to be negligibly small: $P_{<300} \leq 2 \cdot 10^{-5}$.

In preferred embodiments of the invention the target material is tin or its alloy and, based on the results, to ensure ultimate EUV beam cleaning the linear target velocity of more than 80 m/s is chosen to suppress the yield towards the CNT-membrane of microdroplets larger than 300 nm that can penetrate through it.

At a relatively small average laser power of 24 W, the EUV source brightness in the spectral band 13.5+/−0.135 nm was $B_{13.5}$=60 W/mm$^2$·sr, and can be easily scaled up by increasing the laser power.

Figure 7:
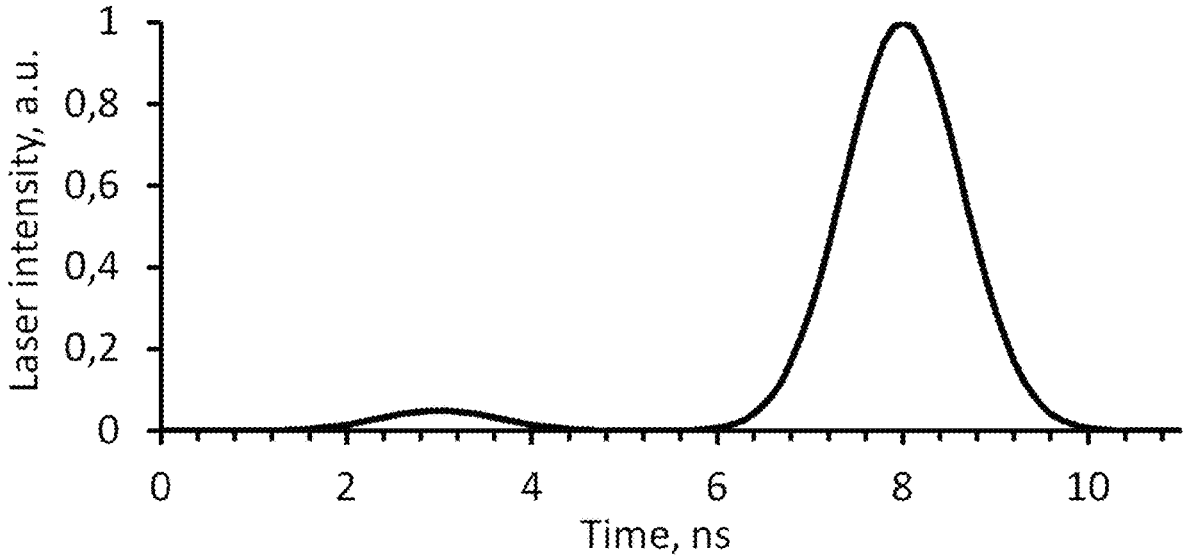

FIG. 7 shows an embodiment of the invention in which the energy beam 5 consists of two parts: a pre-pulse laser beam with relatively low energy and the main pulsed laser beam, which is delayed for some time relative to the pre-pulse. In accordance with the invention, the laser pulse parameters are selected in such a way as to mitigate the fractions of fast ions of debris particles.

Figure 8:
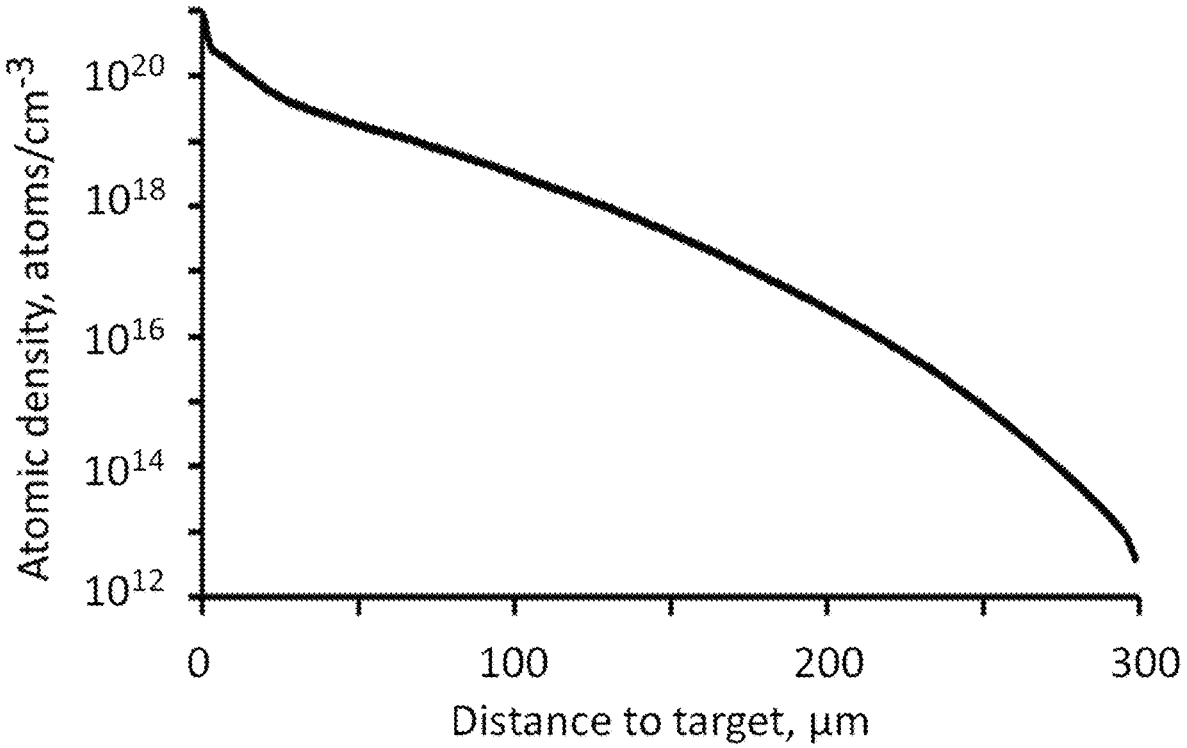

The RZLINE code was used for computational modeling. In one particular case, the laser energy in the pre-pulse is 0.4 mJ, the energy in the main pulse is 4 mJ, the delay between them is 5 ns, the size of the laser spot is 70 μm, the wavelength of the laser radiation is 1 μm, and the target material is tin. For this case, FIG. 8 shows the distribution of vapor density of the target material along the optical axis of the laser beam, created by the laser pre-pulse at a time of 6 ns. A laser beam with a wavelength of about 1 μm is absorbed at an atomic density of ~$3 \cdot 10^{19}$ cm$^3$, i.e. inside an atomic cloud created at the target surface by a pre-pulse. This means that the plasma expanding from this point encounters more distant atoms from the target, thus reducing its velocity and losing kinetic energy.

Figure 9:
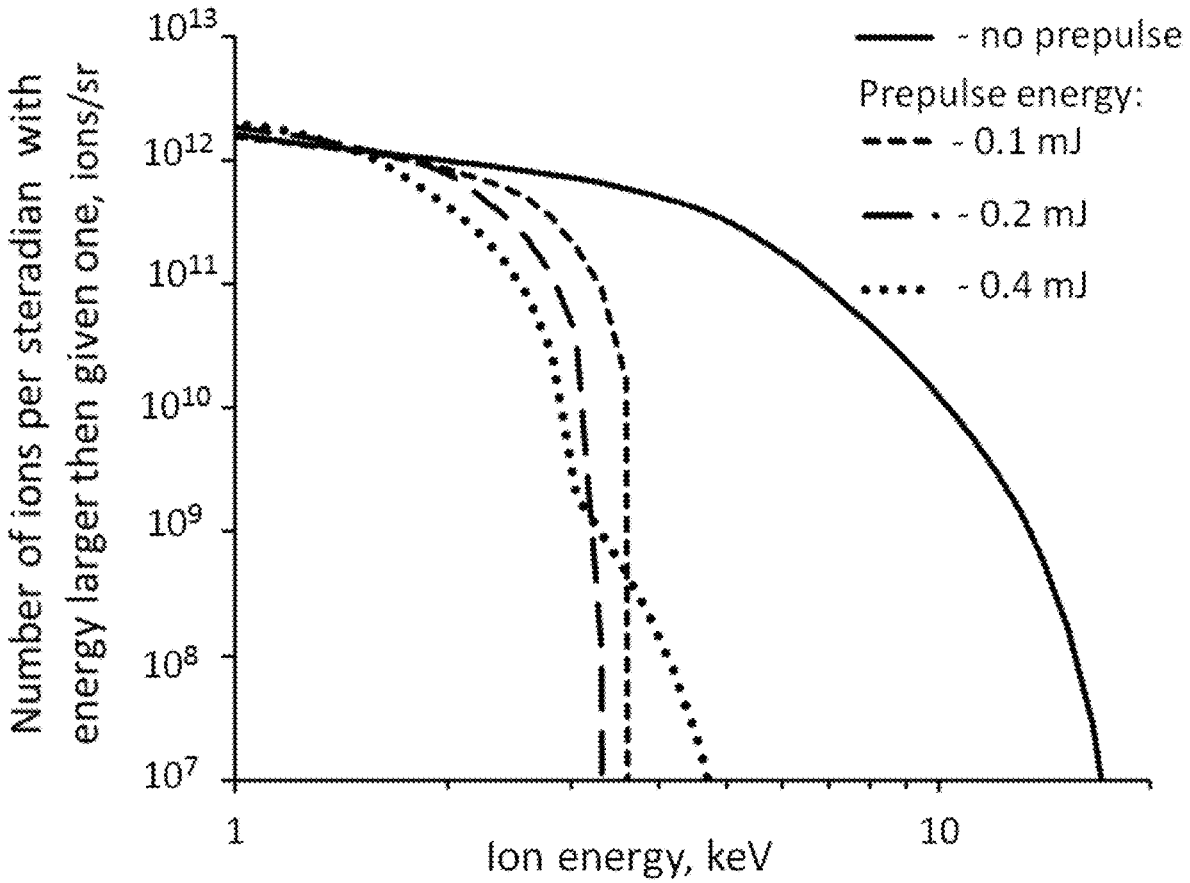

The resulting ion energy distribution in the direction of normal to the target surface 6 ns after the start of the laser pulse is shown in FIG. 9. The simulation results are presented for various cases: without a pre-pulse and with a pre-pulse of different energy at a delay of 5 ns. FIG. 9 shows that the presence of a pre-pulse leads to a decrease in the maximum energy of ions by several times. A pre-pulse with an energy of 0.2 mJ at a delay of 5 ns is optimal in the case under consideration. In general, it is preferred to have a ratio of the pre-pulse laser beam energy to that of main-pulse less than 20% and a time delay between the pre-pulse and the main-pulse less than 10 ns.

Figure 10:
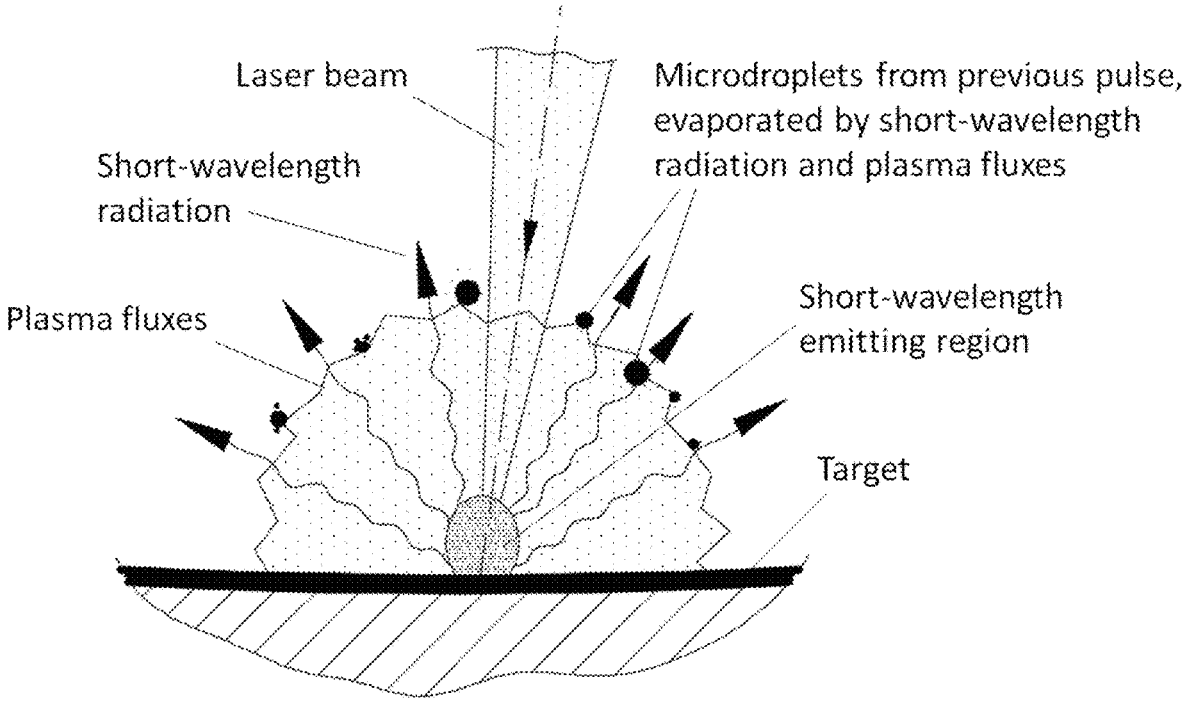

In accordance with another embodiment of the invention, laser pulse repetition rate is chosen sufficiently high enough to provide highly efficient evaporation of the microdroplet fraction of the debris particles of the previous pulse by both short-wavelength radiation and fluxes of laser-produced plasma, FIG. 10. In accordance with this embodiment of the invention, at a sufficiently high pulse repetition frequency, the microdroplet fraction of debris particles from the previous impulse does not have time to fly away from the interaction point a sufficient distance, so that short-wavelength radiation and plasma streams from the next impulse will effectively evaporate it.

Denoting laser pulse repetition frequency as f, average laser power as P, and part of the laser energy used to generate short-wavelength radiation and plasma fluxes as $\chi$, drop velocity as $V_d$, target atom sublimation energy as Es, and target atomic density as $N_t$, the evaporation condition of a microdroplet with diameter d can be written as follows:

$$Q\frac{\pi}{4}\frac{d^2}{2\pi L^2} > \frac{1}{6}\pi d^3 N_t E_s \tag{2}$$

where $Q=P/f \cdot \chi$—energy emitted as a result of one laser pulse in the form of short-wavelength radiation and plasma fluxes; $L=V \cdot d/f$—distance travelled by a drop between two pulses. From (2) follows the limitation on the laser frequency:

$$f > (2/1.5) \cdot \pi \cdot d \cdot N_t \cdot E_s \cdot V_d^2 \chi / (P \cdot \chi).$$

Taking reasonable estimates of parameters for a liquid Sn-target: $N_t=3.5 \cdot 10^{22}$ cm$^3$, $E_s=3 \cdot 1.6 \cdot 10^{-19}$ J/atom, $P=10^3$ W, $\chi \cdot 0.5$, $V_d=3 \cdot 10^4$ cm/s will have:

$$f > 10^{11}\ d[\text{cm}]\text{sec}^{-1}.$$

This means, in particular, that at a frequency off $>10^7$ sec$^{-1}$=10 MHz it is possible to evaporate microdroplets up to 1 μm=$10^{-4}$ cm, thus protecting the laser input window and the output of the short-wavelength beam from them.

Other embodiments of the invention relate to high-brightness sources of X-ray radiation generated by electron bombardment of a target.

Figure 11:
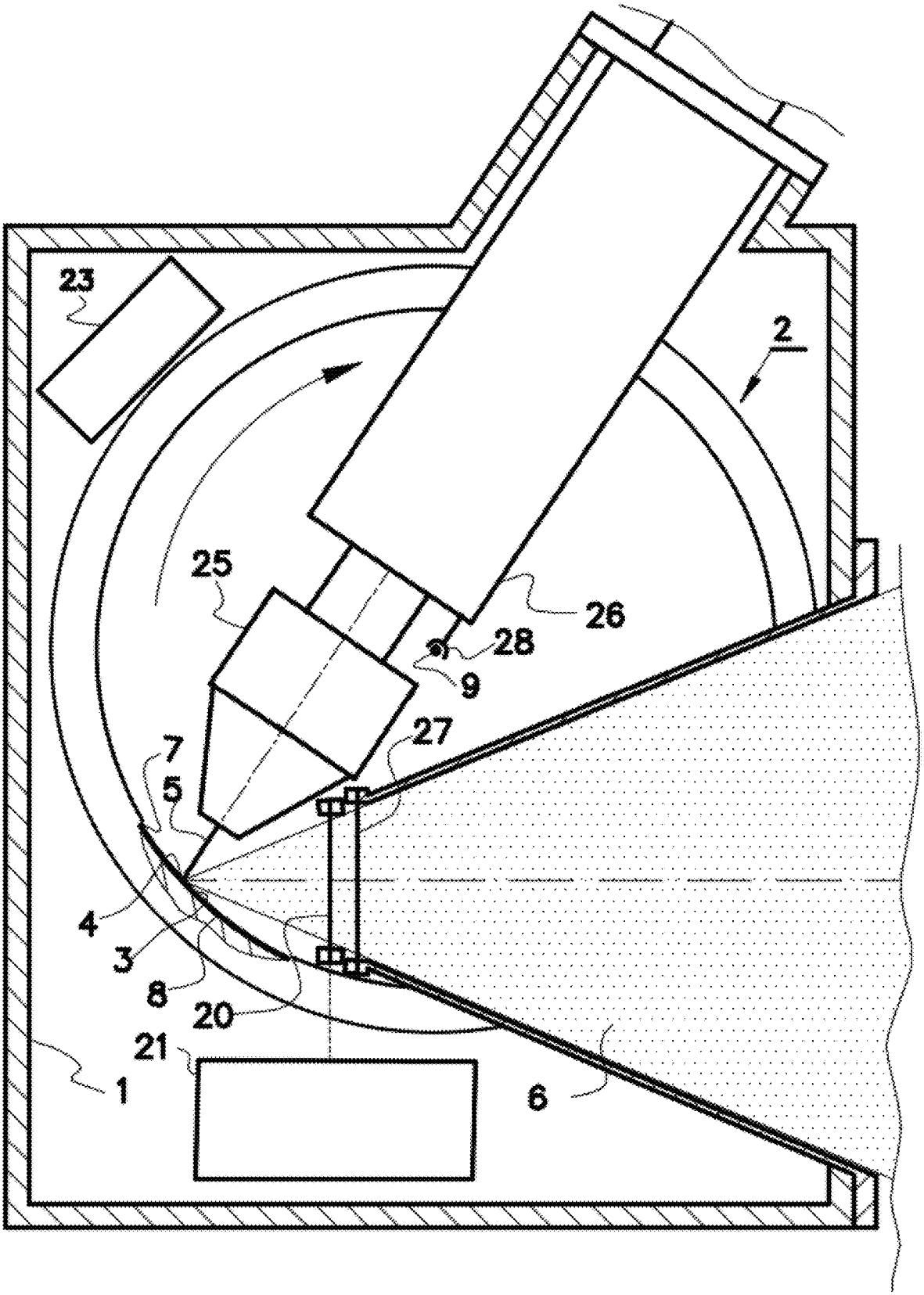

In FIG. 11, an embodiment of a short-wavelength radiation source, namely a high-brightness X-ray source in accordance to the invention, is schematically presented. Parts of the device that in this implementation are the same as in the above implementation variants (FIG. 1, FIG. 4) have the same reference numbers in FIG. 11, and their detailed description is omitted.

In this embodiment of the invention, the energy beam 5 is an electron beam, and the rotating target assembly 2 serves as the rotating anode. The electron gun also includes a cathode module 25 and a power supply unit 26. Anode target 3 is a layer of molten metal formed by centrifugal force on the inverted axis of rotation 9 of the surface 8 of the annular groove 7 of the rotating anode 2. In FIG. 11, the rotation axis 9 is perpendicular to the plane of the drawing. Shortwave radiation is X-ray radiation generated in the interaction zone 4, which is the electron beam focal spot during the electron bombardment of the target 3.

The rotating anode 2 with target 3 is electrically connected to the power supply unit 26 of the electron gun via a sliding contact 28, which is preferably located on the shaft of rotation. Using the power supply 26, a high voltage potential, usually between 40 kV and 160 kV, is applied between the cathode placed in the cathode module 25 and the rotating anode 2. This voltage potential causes the electrons emitted by the cathode to accelerate in the direction of the rotating anode 2, and the electron bombardment of the liquid metal target 3 generates X-ray radiation.

This beam of shortwave, namely, X-ray radiation 6, leaves vacuum chamber 1 through the exit window 27. Sealed exit window 27 preferably consists of thin foil in a frame. Requirements for window material include high transparency for the X-rays, i.e. low atomic number, and sufficient mechanical strength to separate the vacuum from ambient pressure. Beryllium is widely used in such windows.

In embodiments of the invention, the linear target velocity is at least 80 m/s. The high target speed enables operation at high, kilowatt levels of electron beam power and provides more efficient dissipation of the input power in the target. Due to surface tension forces and centrifugal force, the surface of the rotating target is highly stable and resistant to disturbances. At a sufficiently high speed of rotation, the electron beam interacts with the unperturbed "fresh" target surface, which ensures high spatial and energy stability of the X-ray source.

Unlike X-ray sources with a jet liquid metal anode, in the proposed design the level of generated debris is reduced, since such intensive generators of debris as the nozzle and liquid metal jet catcher from which the mist from the target material spreads are eliminated. As a result, no complex evaporative cleaning of the output window or relatively frequent replacement of the window is required. As a result, the proposed invention significantly increases the reliability and usability of the high brightness X-ray source, providing the possibility of its operation without additional debris mitigation techniques.

However, during long-term continuous operation of a high brightness X-ray source, the transparency of the exit window 27 may be reduced by the deposition of vapors and target material clusters on its surface. In this regard, in order to ensure the longest possible operating time without maintenance, debris mitigation techniques can be additionally used to protect the exit window 27 in the vacuum chamber. Preferably, the CNT-membrane installed on the way of X-ray beam output is used as such means. CNT-membrane 20 can be installed close to the exit window 27, providing complete protection from contamination. Having good electrical conductivity, CNT-membrane 20 is preferably grounded to remove electrostatic charge from it.

In embodiment of the invention, in the vacuum chamber 1, a compact node 21 for replacing a CNT membrane is installed after the predetermined value of its transparency reduction has been reached. Preferably, the node 21 replacing the CNT membrane operates without depressurization of the vacuum chamber 1.

The target material is preferably selected from fusible metals, including Sn, Li, In, Ga, Pb, Bi, Zn and their alloys. The preferred target material may be an alloy with a mass fraction of 95% Ga and 5% In, which has a melting point of 25° C. and freezing point of about 16° C. Other possible target materials are Galinstan, which is an alloy containing 68.5% Ga, 21.5% In and 10% Sn with a melting and freezing point of about −19° C.; an alloy containing 66% In and 34% Bi with a melting and freezing point of about 72° C., not limited to them. Preferred for storing and transporting an X-ray source may be target materials that are solid when not in use and require little heating, for example, by the electron beam 5 itself, to go into working mode. In embodiments of the X-ray source, the vacuum chamber may be equipped with a compact heating device 23 to transfer the target material into the molten state.

To increase the X-ray output, it is preferable to use a target material with a high atomic number, e.g., lead-based alloys.

In general, the proposed design of the rotating anode assembly determines a wide range of possibilities for optimizing the target material.

In an embodiment of the invention, cooling of the rotating anode 2 can be radiation-based.

Figure 12:
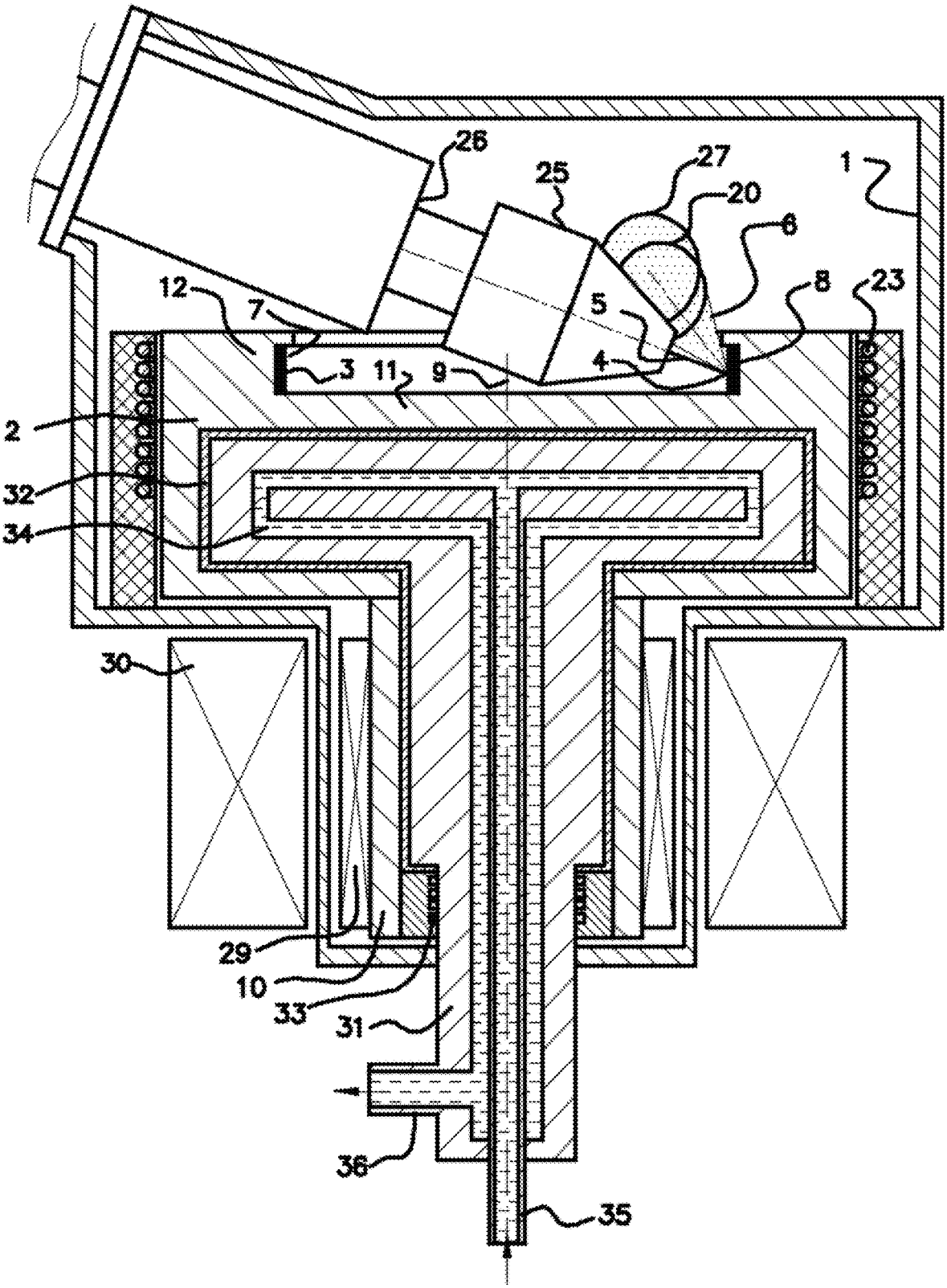

FIG. 12 schematically shows the axial section of a high brightness X-ray source, made in accordance with one of the embodiments of this invention. Parts of the device that are the same in this embodiment as in the above embodiment (FIG. 11) have the same reference numbers in FIG. 12, and their detailed description is omitted.

The device is designed so that the electron beam 5, produced by an electron gun, is directed towards the interaction zone 4 with target 3, which is a layer of molten metal, formed by centrifugal force on the surface of the annular groove of rotating anode 2.

Preferably, the rotation drive consists of the driven and driving parts, located respectively inside and outside the vacuum chamber 1. Thus, in an embodiment of the invention, the rotational drive is made in the form of an electric motor with a cylindrical rotor 29 placed in a vacuum chamber 1 with a cylindrical rotation shaft 10 and a stator 30 located outside the vacuum chamber 1, FIG. 12.

In other embodiments of the invention, the rotational drive may be in the form of a magnetic coupling with a drive outer half-coupling and a driven inner half-coupling.

The rotating anode 2 with rotor 29 is supported by a liquid-metal hydrodynamic bearing which includes a fixed shaft 31 and a layer of liquid metal 32, e.g. gallium or its alloy such as gallium-indium tin (GaInSn).

The rotation shaft 10 is equipped with a sliding seal 33 surrounding the part of the stationary shaft 31. The gap (clearance) between the sliding seal 33 and the stationary shaft 31 has a value that allows the rotor 29 to rotate without leaking any liquid metal 32. For this purpose, the gap width is 500 μm or less. The sliding seal 33 on FIG. 12 has several annular grooves in which liquid metal 32 is accumulated. Thus, the sliding seal 33 functions as a labyrinth sealing ring.

A hydrodynamic bearing with liquid metal can withstand very high temperatures without contaminating the vacuum environments. The large bearing contact area and the liquid metal grease provide a highly efficient heat dissipation from rotating anode 2 by means of a liquid coolant 34, e.g. water or a coolant with a higher boiling point. For the circulation of liquid coolant 34 in the stationary shaft 31, there are inlet 35 and outlet 36 channels, where the direction of flow of the coolant is shown by arrows in FIG. 12.

The X-ray source operates as follows. Vacuum chamber 1 is evacuated. With the help of the motor consisting of stator 30 and rotor 29, carry out rotation of anode 2 with the hydrodynamic bearing including a motionless shaft 31 and a layer of liquid metal 32. After switching on the electron beam 5 in its interaction zone 4 with a rotating liquid metal target 3, a beam of X-ray radiation 6 is generated, leaving the vacuum chamber through the exit window 27. At the same time on the way of the X-ray beam 6 output a replaceable CNT-membrane 20 can be installed, which provides complete protection of the exit window 27 from contamination. Heat removal is carried out through a layer of liquid metal 32 by means of liquid coolant 34.

The X-ray source can operate in continuous or cyclic mode. In the latter case, the anode can be slowed down after each cycle, increasing its service life.

The source of X-ray radiation, made in accordance with the present invention, has such advantages of modern X-ray tubes of cyclic action for tomography, as high, up to 100 kW, operating power achieved at the heat capacity of the rotating anode of 6 MJ.

In addition, it also has the advantages of X-ray sources with a jet liquid-metal anode, which allow to working with very small sizes of focal spots, since there are no restrictions associated with the melting of the target. Accordingly, in the preferred embodiments of the invention, a high brightness X-ray source is a micro-focus one. In these embodiments of the invention, in order to achieve high brightness of the X-ray source, electron-bombardment of the liquid-metal target by a microfocus electron gun with a focal spot size in the range from 50 to 1 μm is carried out. To obtain small focal spot sizes, focusing devices in the form of electrostatic, magnetic and electromagnetic lenses located in cathode module 25 are used.

To reduce the hydrodynamic and thermal load on the target surface in the focal spot, the target is rotated at a high linear velocity, more than 80 m/s Compared to X-ray sources using a jet liquid-metal anode, the target circulation system and the overall design of the radiation source are simplified. Compared to a free-flowing jet, the fast rotating liquid metal target is more stable, in particular because of the centrifugal force, and produces significantly less debris. The geometry of the target allows for the X-ray beam to be output in a direction almost opposite to the direction of the predominant release of debris particles from the interaction zone. The undoubted advantage of the proposed design is the elimination of the need for an extremely complex system of evaporative cleaning of the exit window at temperatures of 1000° C. and above. This simplifies the design, increases the duration of the X-ray source and improves the conditions of its maintenance and operation.

Thus, this invention makes it possible to create the highest brightness sources of VUV and X-ray radiation with a high service life and ease of operation.

INDUSTRIAL APPLICABILITY

The proposed devices are designed for a number of applications, including microscopy, materials science, X-ray diagnostics of materials, biomedical and medical diagnostics, inspection of nano- and microstructures, including actinic inspection of lithographic EUV masks.

What is claimed is:

1. A high-brightness short-wavelength radiation source, containing a vacuum chamber (1) with a rotating target assembly (2) supplying a target (3) into an interaction zone (4); an energy beam (5) focused on the target in the interaction zone; and a useful short-wavelength radiation beam (6) coming out of the interaction zone, wherein the rotating target assembly is made with an annular groove (7), the target is a layer of a target material being molten metal formed by a centrifugal force on a surface (8) of the annular groove facing a rotation axis (9), and the energy beam (5) is either a pulsed laser beam or an electron beam.

2. The source according to claim 1, wherein the rotating target assembly (2) is a disk (11) with a peripheral part in a form of a ring barrier (12), on an inner surface of which, facing the axis of rotation (9), there is the annular groove (7) with a surface profile preventing a release of the target material in a radial direction and in both directions along the axis of rotation (9).

3. The source according to claim 1, wherein the short-wavelength radiation is generated by the energy beam heating the target material to a plasma-forming temperature.

4. The source according to claim 1, wherein the energy beam (5) is the electron beam, the rotating target assembly (2) is a rotating anode of an electron gun, and the short-wavelength radiation is an X-ray radiation generated by an electron bombardment of the target (3).

5. The source according to claim 1, wherein the target material is selected from fusible metals, including Sn, Li, In, Ga, Pb, Bi, Zn and their alloys.

6. The source according to claim 1, additionally containing a replaceable membrane (20) made of carbon nanotubes or CNT-membrane, which is installed in a line-of-sight of the interaction zone, completely covering an aperture of the short-wavelength radiation beam (6).

7. The source according to claim 6, wherein one or more debris mitigation techniques such as electrostatic and magnetic mitigation, protective gas flows and foil traps (18) are additionally used.

8. A high-brightness short-wavelength radiation source, comprising a vacuum chamber (1) with a rotating target assembly (2) supplying a target into an interaction zone (4) with a pulsed laser beam (5) focused onto the target, which is a molten metal layer as a target material, the layer being formed by a centrifugal force on a surface (8) of an annular groove (7), implemented in the rotating target assembly, and means for debris mitigation on the path of the short-wavelength radiation beam output wherein a linear velocity of the target is high enough, more than 20 m/s, to influence a direction of a predominant output of microdroplet fractions of debris particles from the interaction zone, a direction of a short-wavelength beam output from the interaction zone is different from the direction of the predominant output of the microdroplet fractions of debris particles, a replaceable membrane (20) made of carbon nanotubes or CNT membrane with high, more than 50% transparency in a wavelength range shorter than 20 nm, transmission is installed in a line-of-sight of the interaction zone, completely covering an aperture of the short-wavelength radiation beam (6).

9. The source according to claim 8, wherein the target material is tin or its alloy, the linear velocity of the target is large enough, more than 80 m/s, to suppress the output in the direction of the CNT membrane of the microdroplets with a size of more than 300 nm, which are capable of penetrating through the CNT membrane.

10. The source according to claim 8, wherein the CNT membrane is coated on a side outside a line-of-sight of the interaction zone.

11. The source according to claim 8, wherein the CNT membrane serves as a window between compartments of the vacuum chamber with high and medium vacuum.

12. The source according to claim 8, wherein the pulsed laser beam consists of two parts: a pre-pulse laser beam and a main-pulse laser beam, parameters of which are chosen so as to suppress a fast ions fraction of the debris particles.

13. The source according to claim 12, wherein a ratio of the pre-pulse laser beam energy to that of the main-pulse laser beam is less than 20% and a time delay between the pre-pulse and the main-pulse is less than 10 ns.

14. The source according to claim 8, wherein a laser pulse repetition rate is high enough to provide high-efficient evaporation of the microdroplet fractions of debris particles of a previous pulse by both short-wavelength radiation and fluxes of laser-produced plasma.

15. A high brightness X-ray source with a rotating anode, containing a vacuum chamber in which an electron beam (5) produced by an electron gun (28), (27), (2) is directed to an interaction zone (4) with a target (3), which is a layer of molten metal formed by a centrifugal force on a surface (8) of an annular groove (7) of a rotating anode (2).

16. The source according to claim 15, containing a means for debris mitigation.

17. The source according to claim 16, wherein a CNT membrane (20) is installed on a path of an X-ray beam output.

18. The source according to claim 15, wherein the rotating anode (2) is equipped with a liquid cooling system.

19. The source according to claim 15, wherein a size of a focal spot of the electron beam (5) on the target is less than 50 microns.

20. The source according to claim 15, wherein a linear velocity of the target is more than 80 m/s.

* * * * *